United States Patent [19]

Yamada

[11] 4,349,086

[45] Sep. 14, 1982

[54] CIRCULATING FOOD DISPLAY SYSTEM

[76] Inventor: Hideo Yamada, 4-4-17, Ichikawa, Ichikawa-shi, Chiba-ken, Japan

[21] Appl. No.: 171,200

[22] Filed: Jul. 22, 1980

[30] Foreign Application Priority Data

Jul. 27, 1979 [JP] Japan ..... 54-103708[U]

[51] Int. Cl.[3] ..... E04H 3/04

[52] U.S. Cl. ..... 186/49

[58] Field of Search ..... 186/49, 43, 50, 51, 186/38, 44; 52/65; 312/140.1

[56] References Cited

U.S. PATENT DOCUMENTS

| | | | |
|---|---|---|---|
| 1,330,890 | 2/1920 | Mayne | 186/49 |
| 1,825,951 | 10/1931 | Hall | 186/43 |
| 3,378,105 | 4/1968 | Kromer, Jr. | 186/49 |
| 3,575,265 | 4/1971 | Simjian | 186/49 |
| 3,901,355 | 8/1975 | Shiraishi | 186/49 X |

*Primary Examiner*—Stanley H. Tollberg

*Attorney, Agent, or Firm*—Oblon, Fisher, Spivak, McClelland & Maier

[57] ABSTRACT

A circulating food display system, used in a restaurant for the exhibition of food in a circulatory manner has a food display case and a crescent chain. The food display case is disposed on the boundary between the interior and exterior of the restaurant. The case has a window, facing the exterior through which the interior of the food display case is viewed from the exterior. The crescent chain is disposed within the interior of the restaurant. The chain has a circulating locus, continuously extending within a horizontal plane. Part of the locus is disposed inside the food display case, whereby the food is circulated for exhibition.

4 Claims, 7 Drawing Figures

CIRCULATING FOOD DISPLAY SYSTEM

BACKGROUND OF THE INVENTION

This invention relates to circulating food display systems used in eating houses and continually circulating and exhibiting food to be served to customers.

Recently, some of the restaurants that specialize in "sushi" a representative Japanese food, have come to be equipped with endless conveyor with a locus such as crescent chain that continuously moves around, making a loop. A counter is attached along the endless conveyor. A chef who stands by the conveyor, prepares and places various kinds of "sushi" on a plate. Then, he puts the plate on the conveyor. The customers on the other side pick up the plate on the endless conveyor according to their taste, place the plate on the counter and eat "sushi" from it.

From the viewpoint of the customer, this eliminates the trouble of ordering because all he has to do is to pick up a plate. On the side of the restauranteur, he can cut down the process of carrying the food to the customer after receiving the order. Also he can let the chef concentrate on food preparation so that one chef can handle a greater number of customers than the conventional way. Therefore, he may not have to employ any waiter or waitress and as he can reduce the number of chefs, he could manage more efficiently and serve the food at a lower cost.

Some of the restaurants have a food display case, facing the outside. This case is used not only to exhibit the menu to the passers-by so that they could see the quality of the food, compared to other eateries, but also to exhibit for take-out orders.

If the food exhibited in the case is uncooked food such as raw fish, it must be replaced at regular intervals every day to avoid discoloration or spoilage by exposure. Conventionally, such replacement of food is performed manually, and is a troublesome job. Further, the food exhibited in the case loses its freshness with the lapse of time. Accordingly, such food will not only fail to stimulate the appetite of passers-by outside the shop, but give them a false impression that the very food exhibited in the case is to be actually served inside the shop, thereby possibly impairing the credit of the shop.

In order to eliminate the trouble of replacement, in some cases, e.g. plastic or wax molds or photographs are exhibited in the case instead of real food. These molds or photographs will not, however, be able to prod the appetite of passers-by outside the shop. Besides, they will possibly arouse suspicion of the passers-by about the difference between them and real food actually served inside the shop.

SUMMARY OF THE INVENTION

The object of this invention is to provide a circulating food display system including endless conveyor means to be disposed inside a restaurant and capable of exhibiting in a display case food that is actually served inside the restaurant in its fresh state.

DETAILED DESCRIPTION OF THE PREFERRED EMBODIMENTS

Figure 1:
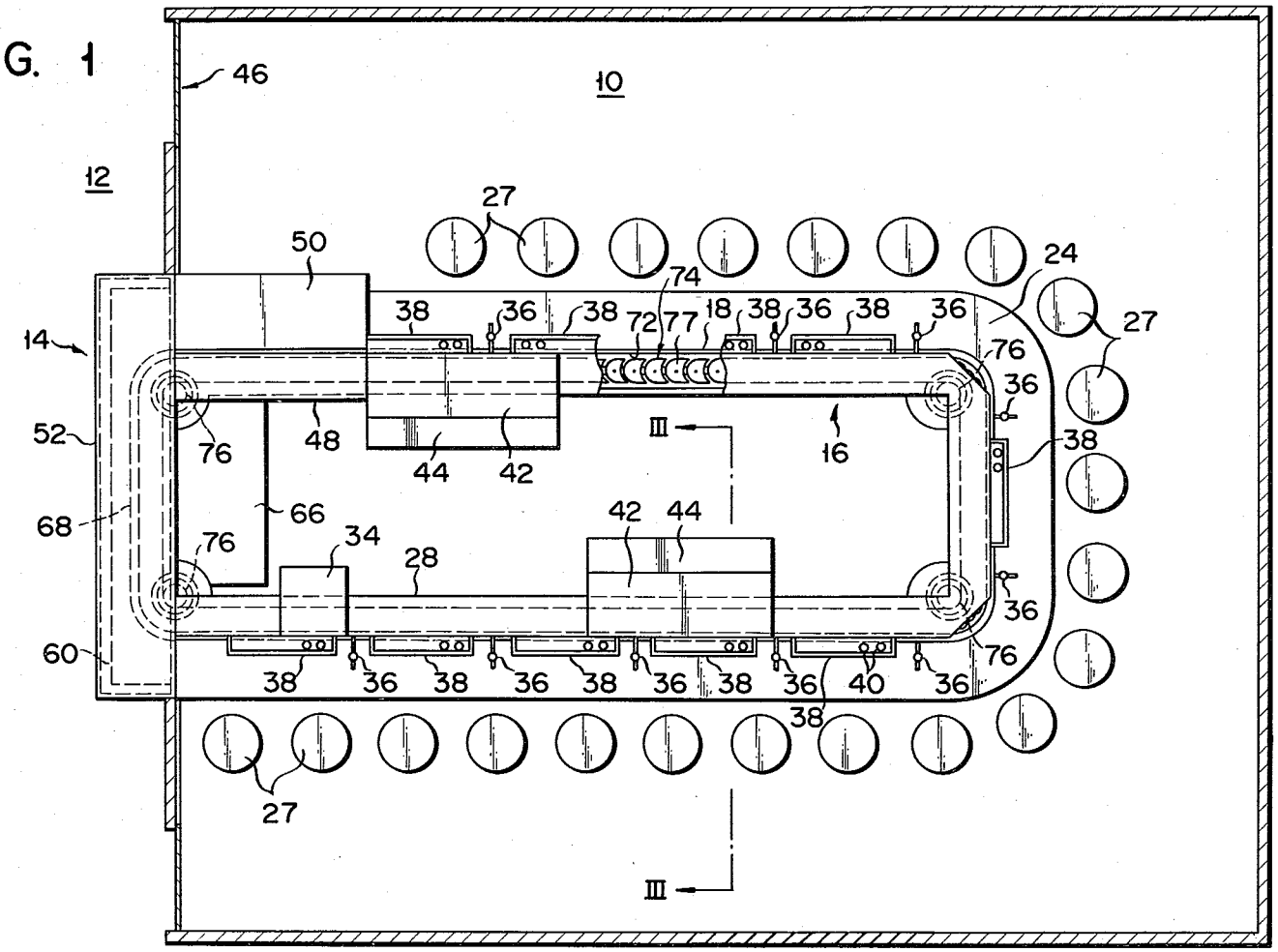
FIG. 1 is a plan view of a circulating food display system according to an embodiment of this invention.

A circulating food display system according to an embodiment of this invention as shown in FIG. 1 is used in a restaurant that specialize in such, a traditional Japanese dish.

The aforesaid system includes a food display case 14, disposed on the boundary between the interior 10 and exterior 12 of the restaurant, as shown in FIG. 1.

Figure 2:
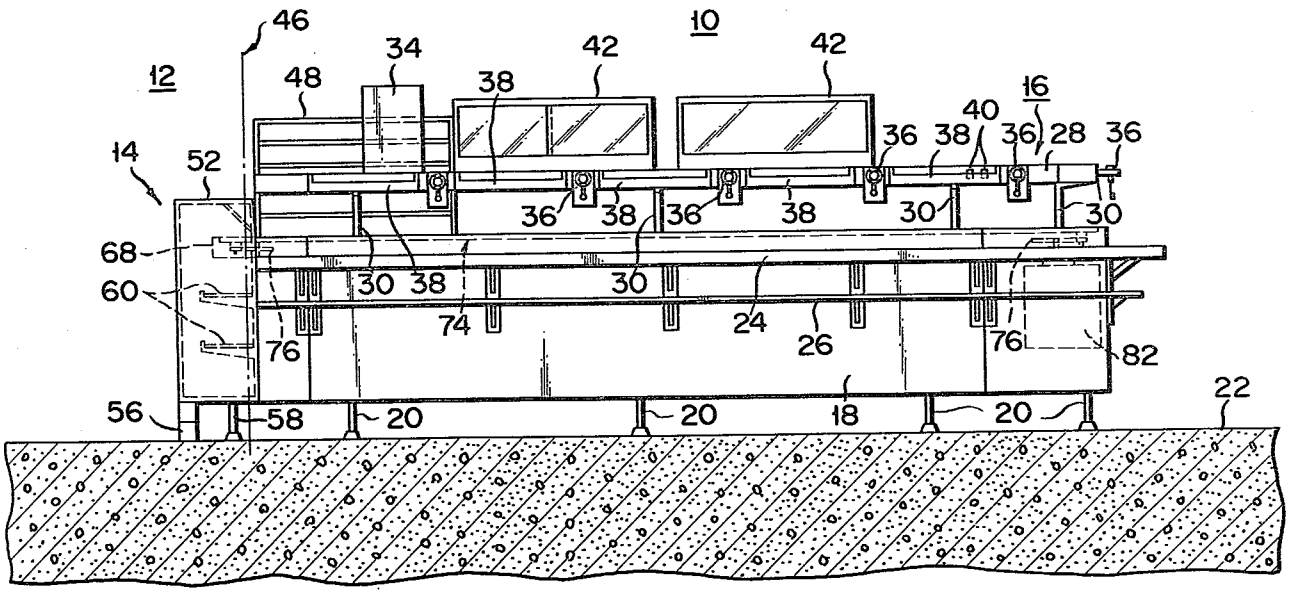
FIG. 2 is a side view of the system of FIG. 1.
Figure 3:
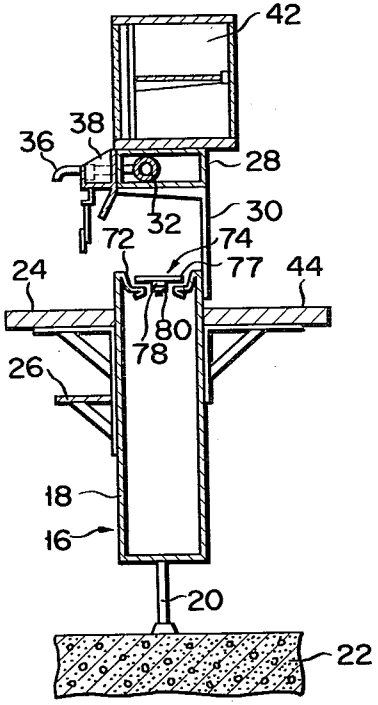
FIG. 3 is a sectional view taken along line III—III of FIG. 1.

The system is further provided with endless conveyor means 16 in the interior 10, as shown in FIG. 1. The conveyor means 16 has a support member 18 with a substantially U-shaped figure in a plan view. Two ends of the support member 18 are connected to both end portions of the back of the case 14, respectively. As shown in FIG. 3, the support member 18 has an oblong cross section elongated in the vertical direction. As shown in FIGS. 2 and 3, the support member 18 is fixed on the ground 22 by means of a plurality of legs 20, attached to the bottom wall thereof. As shown in FIGS. 1 to 3, the outer one of two side walls of the support member 18 is fitted with a counter 24 all around. As shown in FIGS. 2 and 3, the outer side wall of the support member 18 is also fitted all around with a shelf 26 to place customer's belongings. The shelf 26 is located under the counter 24. Within the interior 10, a plurality of chairs 27 are disposed all around the counter 24, as shown in FIG. 1.

Over the upper side of the support member 18, as shown in FIGS. 1 to 3, a hollow member 28 with a substantially U-shaped figure in plan view is disposed in parallel with the upper side. As shown in FIGS. 2 and 3, the hollow member 28 is fixed to the end portions of a plurality of braces 30, the other end portions of which are fixed to the inner side wall of the support member 18. The hollow member 28 houses a pipe 32 extending all around, as shown in FIG. 3. One end of the pipe 32 is connected to a liquid source 34—a tea supplier, filled with green tea to supply the same in the present embodiment. As shown in FIGS. 1 to 3, the hollow member 28 is provided with a plurality of taps 36 protruding above the counter 24. The taps 36 are connected to the pipe 32, as shown in FIG. 3. In this embodiment, the liquid source 34, pipe 32, and taps 36 constitute liquid supply means for supplying customers sitting at the counter 24 with a liquid—green tea in this embodiment.

As shown in FIGS. 1 to 3, the hollow member 28 is fitted with a plurality of vessel holding means 38—vessel containing boxes with top opening in this embodiment. As shown in FIGS. 1 and 2, each of the vessel holding means 38 carries a plurality of vessels 40 containing green tea, supplied from each tap 36.

As shown in FIGS. 1 to 3, a plurality of food display subcases 42 are fixed on top of the hollow member 28. Each of the subcases 42, as shown in FIGS. 2 and 3, has outside and inside walls, made of transparent glass. In each subcase 42, various kinds of "sushi" ingredients, such as raw fishes, flesh of shellfishes, prawns, fried eggs and so on are placed. A working table 44 for preparation is fixed to the inner side wall of the support member 18 at a position under each subcase 42.

In the present embodiment, a shelf 48 for storing various goods is fixed on the top of the hollow member 28 at a position near a doorway 46 of the restaurant. A table 50 for cashier to put a register is fixed to a portion of the counter 24 underlying the shelf 48.

Figure 5:
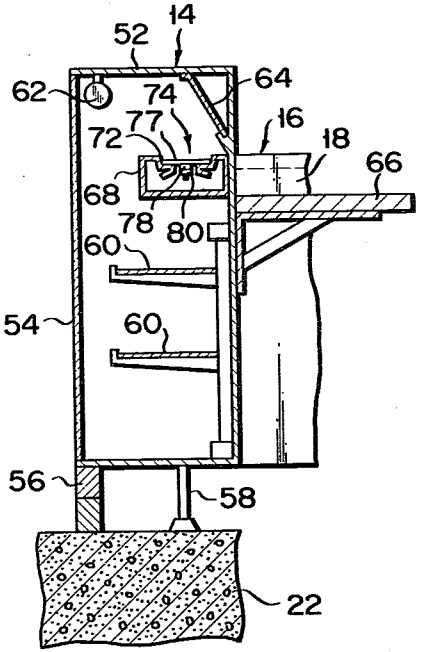
FIG. 5 is a sectional view taken along line V—V of FIG. 4.
Figure 4:
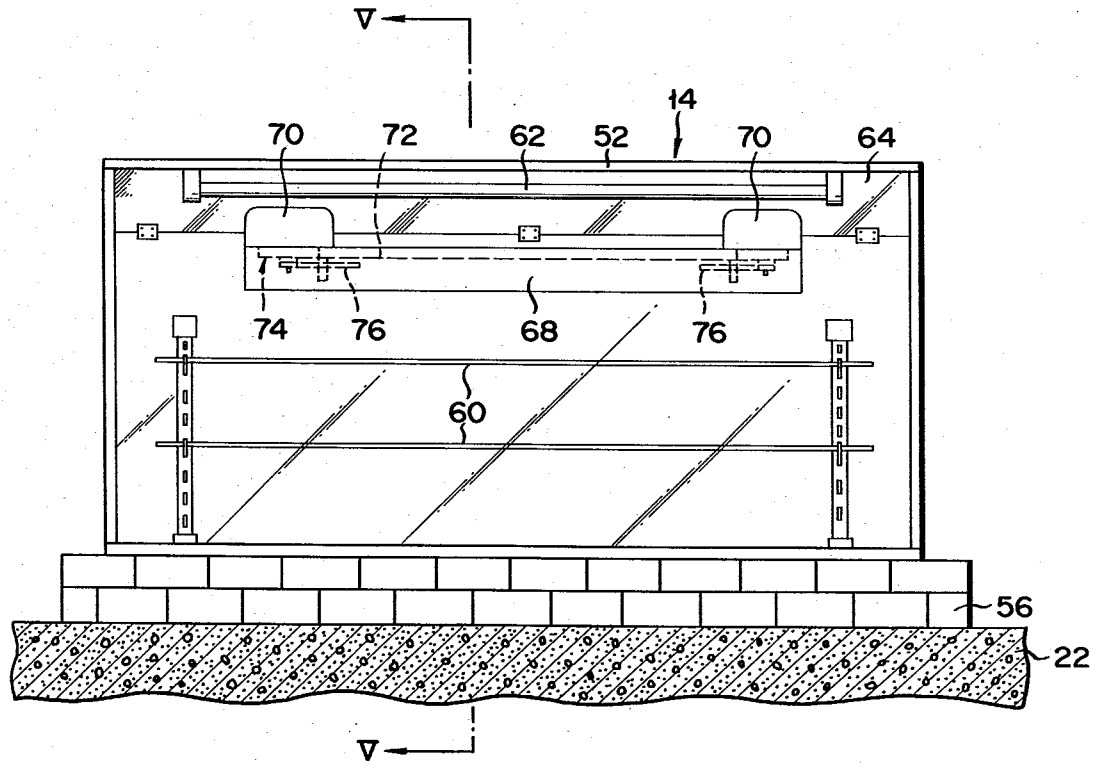
FIG. 4 is a front view of a food display case shown in FIG. 1.

As shown in detail in FIG. 5, the food display case 14 includes a housing 52 having a rectangular cross section. Front wall of the housing 52, as shown in FIGS. 4 and 5, is a window, covered with a transparent glass pane 54 through which the interior of the housing can be seen from the exterior 12 of the restaurant. As shown in detail in FIG. 5, the housing 52 is fixed on the ground 22 by means of bricks 56, attached to the bottom wall thereof and a plurality of legs 58. As shown in detail in FIGS. 5 and 6, the housing 52 houses a plurality of shelves 60, located below the upper side of the support member 18. In the present embodiment, various kinds of packaged "sushi" for takeout are placed on the shelves 60 to be exhibited for passers-by out in the exterior 12. A fluorescent lamp 62 is disposed near the inner surface of the top wall of the housing 52. Also, a mirror 64 is disposed in the housing 52 at a corner, defined between the top and rear walls of the housing 52. The mirror 64 efficiently reflects light from the fluorescent lamp 62, thereby enabling the "sushi" exhibited inside the housing 52 to appeal to the passers-by out in the exterior 12. As shown in FIGS. 1 and 5, a working table 66 for preparation is fixed to the outer surface of the rear wall of the housing 52.

Between two positions corresponding to the upper sides of the two ends of the support member 18, as shown in detail in FIGS. 4 and 5, a conveyor base 68 having an upper side flush with the upper side of the support member 18 is fixed to the inner surface of the rear wall of the housing 52. As shown in FIG. 4, moreover, two openings 70 are formed upward from the two corresponding positions.

On the upper sides of the conveyor base 68 and the support member 18, as shown in detail in FIGS. 3 and 5, a guide path 72 for an endless conveyor generally known as a crescent chain is continuously attached and makes a loop shaped locus. As shown in FIG. 1, the guide path 72 has a substantially rectangular figure in a plan view which continuously extends within a horizontal plane, a portion of the guide path 72 on the conveyor base 68 being disposed inside the food display case 14.

As shown in detail in FIGS. 1, 3 and 5, a crescent chain 74 is disposed on the guide path 72. Accordingly, the crescent chain 74 has a substantially rectangular circulating locus which continuously extends within a horizontal plane, part of the locus being disposed inside the food display case 14. As shown in detail in FIGS. 1, 2 and 4, sprockets 76, capable of rotating within a horizontal plane are located in positions corresponding to the four corners of the circulating locus. In the crescent chain 74, as shown in FIGS. 1, 3 and 5, a plurality of plate-like members 77 each having a substantially crescent-shaped figure in a plan view are rotatably coupled with one another within the same plane by means of link plates 78, arranged along the under surfaces of the plate-like members 77. As shown in FIGS. 3 and 5, roller 80 is rotatably disposed at coupling portion between link plate 78 and plate-like member 77. The four sprockets 76 engage the rollers 80 from the inner periphery side of the crescent chain 74, thereby smoothing the circulation of the crescent chain 74 at the four corners of the locus. As shown in FIG. 2, one of the four sprockets 76 is fixed to the output shaft of a driving mechanism 82, disposed in the support member 18 and including an electric motor (not shown) and a reduction gear (not shown). Thus, the crescent chain 74 is driven by the driving mechanism 82 to circulate continuously along the guide path 72. In the present embodiment, one of the sprockets 76 and the driving mechanism 82 form driving means, and the driving means, remaining three sprockets 76, guide path 72, and crescent chain 74 constitute endless conveyor means.

With the circulating food display system according to the first embodiment of this invention having the above-mentioned construction, a chef of the restaurant stands on the inner side of the loop shaped locus of rectangular crescent chain 74. The cook prepares various kinds of "sushi" on the top of the working table 44 or 66, using various kinds of "sushi" ingredients, such as raw fishes, flesh of shellfishes, prawns, fried eggs and so on picked out from the food display subcase 42. Thereafter, he places a given number of "sushi" on a plate each of its kind, and then puts the plate on the crescent chain 74. The plate moves in the moving direction of the crescent chain 74, and continuously circulates along the guide path 72 within a horizontal plane, making a loop. At this time, the "sushi," placed on the plate on the crescent chain 74 is exhibited for passers-by out in the exterior 12 of the restaurant through the food display case 14, as well as for the customers sitting on the chairs 27 at the counter 24 in the interior 10. Each customer chooses one among the various plates of "sushi," circulating for exhibition on the crescent chain 74 according to his preference, keeps the plate at hand on the counter 24, and eats "sushi," placed on the plate.

As described above in detail, the circulating food display system of this invention comprises a food display case, disposed on the boundary between the interior and exterior of a restaurant and having a window facing on the exterior through which the interior of the food display case can be seen from the exterior of the restaurant, and endless conveyor means, disposed within the interior and having a circulating locus continuously extending within a horizontal plate, part of the locus being disposed inside the food display case, whereby food is circulated for exhibition. Accordingly, food actually served within the restaurant can be exhibited always in a fresh state in the display case without requiring any trouble.

In the circulating food display system according to the preferred embodiment of the invention, the endless conveyor means includes the crescent chain 74 and the driving means for driving the crescent chain 74. Thus, the endless conveyor means can have a simple construction.

According to the preferred embodiment of the invention, the circulating food display system further comprises the counter 24 disposed along the endless conveyor means, specifically along the guide path 72 and crescent chain 74. Thus, a customer of the restaurant can eat food of his choice at the counter after he chooses it among several kinds, being circulated for exhibition by the endless conveyor means, so that he may enjoy a leisurely meal in a relaxed atmosphere.

In the preferred embodiment of the invention, the circulating food display system further comprises the food display subcases 42 arranged along the endless conveyor means, specifically along the guide path 72 and crescent chain 74. Thus, specifically at a restaurant that serves such food as "sushi," i.e. food using raw fishes and the like as part of its ingredients, customers actually look at the next food that they want to eat which is a good appetite stimulant as they can anticipate the taste of the food.

In the preferred embodiment of this invention, the circulating food display system comprises liquid supply means along the endless conveyor, specifically along the guide path 72 and crescent chain 74, which provides the customers who are positioned around the counter 24 with liquid. Thus, the customers at this restaurant, after obtaining the vessel for liquid, can drink liquid as he chooses without ordering for another, which can eliminate one process of the operation. This liquid could be green tea, black tea, coffee, juice, cola, beer, or other kinds of alcoholic beverage.

According to the preferred embodiment of the invention, the liquid supply means includes the liquid source 34, filled with green tea. Thus, if the restaurant is a "sushi" shop, they can serve liquid, best suited to the taste of "sushi" by the liquid supply means.

According to the preferred embodiment of the invention, the circulating food display system further comprises the vessel holding means 38, arranged along the endless conveyor means, specifically along the guide path 72 and crescent chain 74, whereby vessels to contain the green tea are held. Thus, customers of the restaurant can have the liquid freely whenever they like, without taking the trouble to ask an employee for the liquid and vessel.

In the circulating food display system according to the preferred embodiment of the invention, the endless conveyor means, specifically the guide path 72 and crescent chain 74 have a substantially rectangular figure in a plan view, one side of such rectangle, being located inside the food display case 14. Thus, by positioning chefs inside of the loop, made of guide path 72 and crescent chain 74, and customers outside of the loop, a restauranteur can reduce the scope of the chef's movement and increase the number of customers, handled by one chef.

It is to be understood that the above-mentioned embodiment is for purpose of illustration only and is not intended as a definition of the limits of the invention, and that various changes and modifications may be effected by one skilled in the art without departing from the scope or spirit of the invention.

Figure 6:
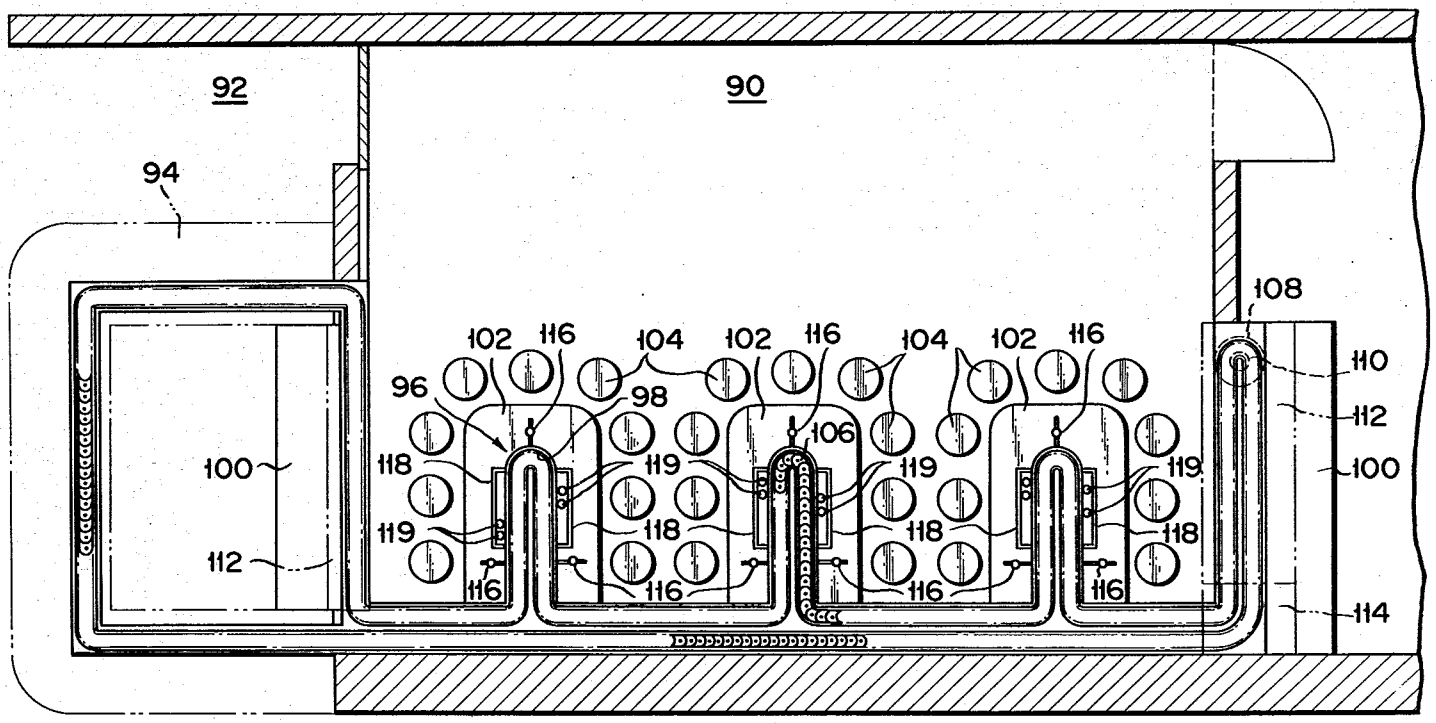
FIG. 6 is a plan view of a circulating food display system according to a modification of the embodiment of the invention.

As shown in FIG. 6, for example, a food display case 94 with a substantially U-shaped figure in a plan view is disposed on the boundary between the interior 90 and exterior 92 of a restaurant. The food display case 94 has a housing with a rectangular cross section. The front wall of the housing is a window, covered with transparent glass through which the interior of the housing can be seen from the exterior 92 of the restaurant.

As shown in FIG. 6, a conveyor base 96, making a loop shaped locus with a substantially comb-shaped figure in a plan view is disposed in the interior 90 of the restaurant. The top side of the conveyor base 96 is set within a horizontal plane, and a guide path 98 for an endless conveyor, generally known as a crescent chain is located continuously through out the loop. One of two portions of the guide path 98 forming tooth sections thereof at both ends, out of a plurality of portions of the guide path 98 forming a plurality of substantially comb-shaped tooth sections, is disposed all along the inner periphery of the food display case 94, as shown in FIG. 6. Working table 100 for preparation are disposed respectively along the two portions of the guide path 98, forming the tooth sections at both ends. As shown in FIG. 6, counters 102 are disposed along a plurality of other portions of the guide path 98, forming the remaining tooth sections between both the end tooth sections. As shown in FIG. 6, furthermore, a plurality of chairs 104 are disposed along the outer periphery of each counter 102. A crescent chain 106 is disposed in the guide path 98 over the whole length thereof. As shown in FIG. 6, the crescent chain 106 is driven by a sprocket 110, located below the conveyor base 96 and fixed to the output shaft of a driving mechanism 108 including an electric motor and a reduction gear. The crescent chain 106 has a circulating locus which extends continuously along one direction in the guide path 98 of the conveyor base 96. In this modification, the sprocket 110 and the driving mechanism 108 form driving means, and the driving means, guide path 98, and crescent chain 106 constitute endless conveyor means.

In the present modification, as shown in FIG. 6, food display subcases 112 are disposed above the working table 100 respectively along the two portions of the guide path 98 forming the two end tooth sections. The construction and function of the food display subcases 112 are the same as those of the food display subcases 42 of the foregoing embodiment. In each of the subcases 112, various kinds of ingredients for making "sushi," such as raw fishes, fleshes of shellfishes, prawns, fried eggs and so on are placed. In this modification, liquid supply means for serving liquid to customers, sitting at the counters 102 is disposed along the conveyor base 96. The liquid supply means of this modification have the same construction and function as the counterpart of the foregoing embodiment. Namely, the liquid supply means is composed of a pipe (not shown), a liquid source 114 (a tea supplier filled with green tea to supply the same in this modification) connected to one end of the pipe and a plurality of taps 116, connected to the pipe and extending above the counter 102. In this modification, as shown in FIG. 6, a plurality of vessel holding means 118 are disposed along the conveyor base 96. The vessel holding means 118 have the same construction and function as those of the vessel holding means 38 of the foregoing embodiment. As shown in FIG. 6, each of the vessel holding means 118 carries a plurality of vessels 119 to contain green tea, supplied from each tap 116.

With the system of this modification, a cook of the restaurant prepares various kinds of "sushi" on the top of the working table 100, using various kinds of "sushi" ingredients such as raw fishes, flesh of shellfishes, prawns, fried eggs and so on, picked out from the food display subcase 112. Thereafter, he places a given number of "sushi" on a plate each of its kind, and then puts the plate on the crescent chain 106. The plate on the crescent chain 106 moves in the moving direction of the crescent chain 106, and continuously circulates along the guide path 98 within a horizontal plane. At this time, the "sushi," placed on the plate on the crescent chain 106 is exhibited for passers-by out in the exterior 92 of the restaurant through the food display case 94, as well as for the customers sitting on the chairs 104 at the counter 102 in the interior 90.

Figure 7:
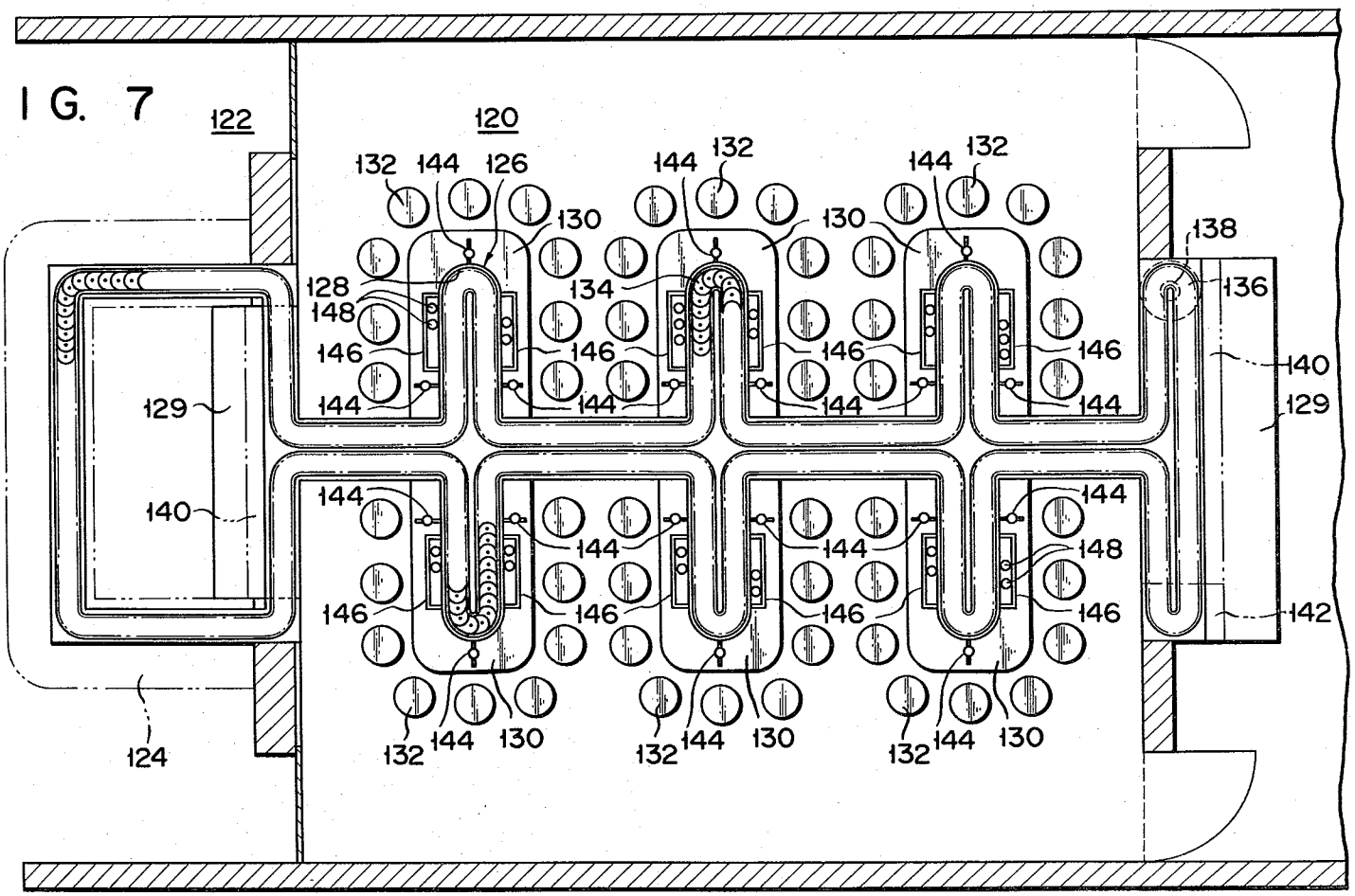
FIG. 7 is a plan view of a circulating food display system according to another modification of the embodiment of the invention.

Alternatively, as shown in FIG. 7, a food display case 124 with a substantially U-shaped figure in a plan view is disposed on the boundary between the interior 120 and exterior 122 of a restaurant. The food display case 124 has a housing with a rectangular cross section. The front wall of the housing is a window, covered with transparent glass through which the interior of the housing can be seen from the exterior 122 of the restaurant.

As shown in FIG. 7, a conveyor base 126, making a loop shaped locus with a form of two parallel combs, arranged back to back in a plan view is disposed in the interior 120 of the restaurant. The top side of the conveyor base 126 is set within a horizontal plane and a guide path 128 for an endless conveyor, generally known as a crescent chain is located continuously through out the loop. One of two portions of the guide path 128 forming tooth sections thereof at both ends, out of a plurality of portions of the guide path 128 forming a plurality of tooth sections of the double-comb-shaped structure, is disposed all along the inner periphery of the food display case 124, as shown in FIG. 7. Working table 129 for preparation are disposed respectively along the two portions of the guide path 128 forming the tooth sections at both ends. As shown in FIG. 7, counters 130 are disposed along a plurality of other portions of the guide path 128 forming the remaining tooth sections between both the end tooth sections. As shown in FIG. 7, furthermore, a plurality of chairs 132 are disposed along the outer periphery of each counter 130. A crescent chain 134 is disposed in the guide path 128 over the whole length thereof. As shown in FIG. 7, the crescent chain 134 is driven by a sprocket 138, located below the conveyor base 126 and fixed to the output shaft of a driving mechanism 136 including an electric motor and a reduction gear. The crescent chain 134 has a circulating locus which extends continuously along one direction in the guide path 128 of the conveyor base 126. In this modification, the sprocket 138 and the driving mechanism 136 form driving means, and the driving means, guide path 128, and crescent chain 134 constitute endless conveyor means.

In the present modification, as shown in FIG. 7, food display subcases 140 are disposed above the working table 129 respectively along the two portions of the guide path 128 forming the two end tooth sections. The construction and function of the food display subcases 140 are the same as those of the food display subcases 42 of the foregoing embodiment. In each of the subcases 140, various kinds of "sushi" ingredients, such as raw fishes, flesh of shellfishes, prawns, fried eggs and so on are loaded. In this modification, liquid supply means for serving liquid to customers, sitting at the counters 130 is disposed along the conveyor base 126. The liquid supply means of this modification have the same construction and function as the counterpart of the foregoing modification. Namely, the liquid supply means is composed of a pipe (not shown), a liquid source 142 (a tea supplier filled with green tea to supply the same in this modification) connected to one end of the pipe, and a plurality of taps 144, connected to the pipe and extending above the counter 130. In this modification, as shown in FIG. 7, a plurality of vessel holding means 146 are disposed along the conveyor base 126. The vessel holding means 146 have the same construction and function as those of the vessel holding means 38 of the foregoing embodiment. As shown in FIG. 7, each of the vessel holding means 146 carries a plurality of vessels 148 to contain green tea, supplied from each tap 144.

With the system of this modification, a cook of restaurant prepares various kinds of "sushi" on the working table 129, using various kinds of "sushi" ingredient, such as raw fishes, flesh of shellfishes, prawns, fried eggs and so on, picked out from the food display subcase 140. Thereafter, he places a given number of "sushi" on a plate for each of its kind, and then puts the plate on the crescent chain 134. The plate on the crescent chain 134 moves in the moving direction of the crescent chain 134, and continuously circulates along the guide path 128 within a horizontal plane. At this time, the "sushi," placed on the plate on the crescent chain 134 is exhibited for passers-by out in the exterior 122 of the restaurant through the food display case 124, as well as for the customers sitting on the chairs 132 at the counter 130 in the interior 120.

What is clamed is:

1. A circulating food display system used for circulating food for exhibition in a restaurant, comprising:

a food display case, disposed on the boundary between the interior and exterior of the restaurant and having a window facing said exterior;

a covering means covering said window for preventing dust from entering into said food display case through said window but through which the interior of said food display case is viewed from said exterior;

a guide means defining an endless circulating path extending in said interior of said restaurant and in the interior of said food display case;

a counter disposed along a part of the outside peripheral edge of said guide means which is located in said interior of said restaurant;

a transparent shelter means sheltering a part of said guide means which is located in said interior of said restaurant, and having openings opened toward said counter;

liquid supply means disposed along said part of the outside peripheral edge of said guide means and supplying liquid to a customer or customers sitting or standing at said counter;

endless conveyor means disposed in said endless circulating path and having a crescent chain and driving means for driving said crescent chain and having a circulating locus continuously extending within a horizontal plane.

2. A circulating food display system according to claim 1, wherein said liquid supply means includes a source of liquid supply filled with green tea.

3. A circular food display system according to claim 2, further comprising vessel holding means disposed along said part of the outer peripheral edge of said guide means and to hold vessels for containing said green tea.

4. A circular food display system according to claim 1, further comprising food display subcases arranged along said part of the outer peripheral edge of said guide means.

* * * * *